US005794303A

United States Patent [19]

Sanfilippo et al.

[11] Patent Number: 5,794,303

[45] Date of Patent: Aug. 18, 1998

[54] HAND HELD VACUUM AND SCRAPER COMBINATION

[76] Inventors: Jakie Sanfilippo; Donna Sanfilippo, both of 758 Burkshire Dr., Corpus Christi, Tex. 78412

[21] Appl. No.: 608,399

[22] Filed: Feb. 28, 1996

[51] Int. Cl.[6] ..... A47L 5/26

[52] U.S. Cl. ..... 15/344; 15/339; 15/352; 15/383; 15/401; 451/358

[58] Field of Search ..... 15/344, 352, 401, 15/339, 383; 451/344, 358, 456

[56] References Cited

U.S. PATENT DOCUMENTS

| | | | |
|---|---|---|---|
| D. 338,190 | 8/1993 | Bart | D32/18 |
| D. 338,752 | 8/1993 | Bart | D32/18 |
| 922,225 | 5/1909 | Wegner | 15/344 |
| 2,205,599 | 6/1940 | Mitchell | 15/344 |
| 3,914,820 | 10/1975 | Hankel | 15/344 |
| 4,124,956 | 11/1978 | Levinson | 451/456 |
| 4,920,608 | 5/1990 | Hult et al. | 15/339 |
| 4,993,106 | 2/1991 | Hult et al. | 15/339 |
| 5,025,529 | 6/1991 | Hult et al. | 15/344 |
| 5,290,082 | 3/1994 | Palmer et al. | 294/64.1 |

*Primary Examiner*—Chris K. Moore
*Attorney, Agent, or Firm*—David L. Volk

[57] ABSTRACT

A hand-held, pocket size vacuum with scraper combination is disclosed which is primarily for use when rubbing off and cleaning up the scrapings left behind from a "scratch-off" lottery ticket. Activated by a power switch and battery, the DC Motor and centrifugal blower are located directly above a removable residue cartridge with filter. The centrifugal blower creates a flow of air between an intake port and discharge ports which flows past the storage container which collects the scrapings for subsequent disposal. The device becomes a scraping device through use of the scraper blade or abrasive wheel mechanism which is affixed to one end of the unit near the vacuum intake port.

6 Claims, 3 Drawing Sheets

HAND HELD VACUUM AND SCRAPER COMBINATION

BACKGROUND OF THE INVENTION

1. Field of the Invention

The present invention relates generally to vacuum producing appliances and, more particularly, to a hand held vacuum device in combination with a scraper for scratching off instant lottery tickets.

2. Description of the Related Art

In the related art, portable hand held and battery powered vacuum appliances are well known and widely available. Typical of portable hand held vacuums currently available is that disclosed in U.S. Pat. No. 5,025,529 and U.S. Pat. No. 4,993,106, and U.S. Pat. No. 4,920,608, all issued in the name of Hult et al. As is generally the case, such appliances are general purpose cleaning tools, and function in a manner similar to their larger, full sized equivalents.

Also known are specialty vacuum tools such as the battery operated hand held vacuum handling device as disclosed in U.S. Pat. No. 5,290,082, issued in the name of Palmer et al. As disclosed in the Palmer et al. reference, such a device is intended for use in grasping and moving light weight objects.

A particular problem is associated with the proliferation of instant lottery tickets. These "scratch-off" type of instant lottery tickets have become widely available, and generally result in debris resulting from removal of the opaque scraped material used to block the identifying information of such lottery tickets. And, although such general purpose portable vacuum devices can be used to remove such debris, such a use is rarely convenient or practical. Consequently, a need has been felt for providing an apparatus and method which can easily and portably aid a user in scraping material from the surface of an instant lottery ticket while at the same time providing a means of cleaning up the debris left by such scrapings.

SUMMARY OF THE INVENTION

It is therefore an object of the present invention to provide an improved hand held vacuum and scraper combination.

It is a feature of the present invention to provide an improved hand held device which provides a scraper means for scraping instant type lottery tickets while simultaneously providing a vacuum means for removing the debris caused by such scrapings.

Briefly described according to one embodiment of the present invention, a hand-held, pocket size vacuum with scraper combination is disclosed which, among other uses, is primarily for use when rubbing off and cleaning up the scrapings left behind from a "scratch-off" lottery ticket. Activated by a power switch and battery, the DC Motor and centrifugal blower are located directly above a removable residue cartridge with filter. The centrifugal blower creates a flow of air between an intake port and discharge ports which flows past the storage container which collects the scrapings for subsequent disposal. The device becomes a scraping device through use of the scraper blade mechanism which is affixed to one end of the unit.

In accordance with a preferred embodiment the present invention is most obviously beneficial for quick cleanups, but not limited to lottery ticket scrapings.

Further, the pocket size of the unit and the handy clip feature of the preferred embodiment of the present invention make transport a snap, and the scraper blade ends purse and pocket searches for coins, most frequently used for uncovering lottery numbers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
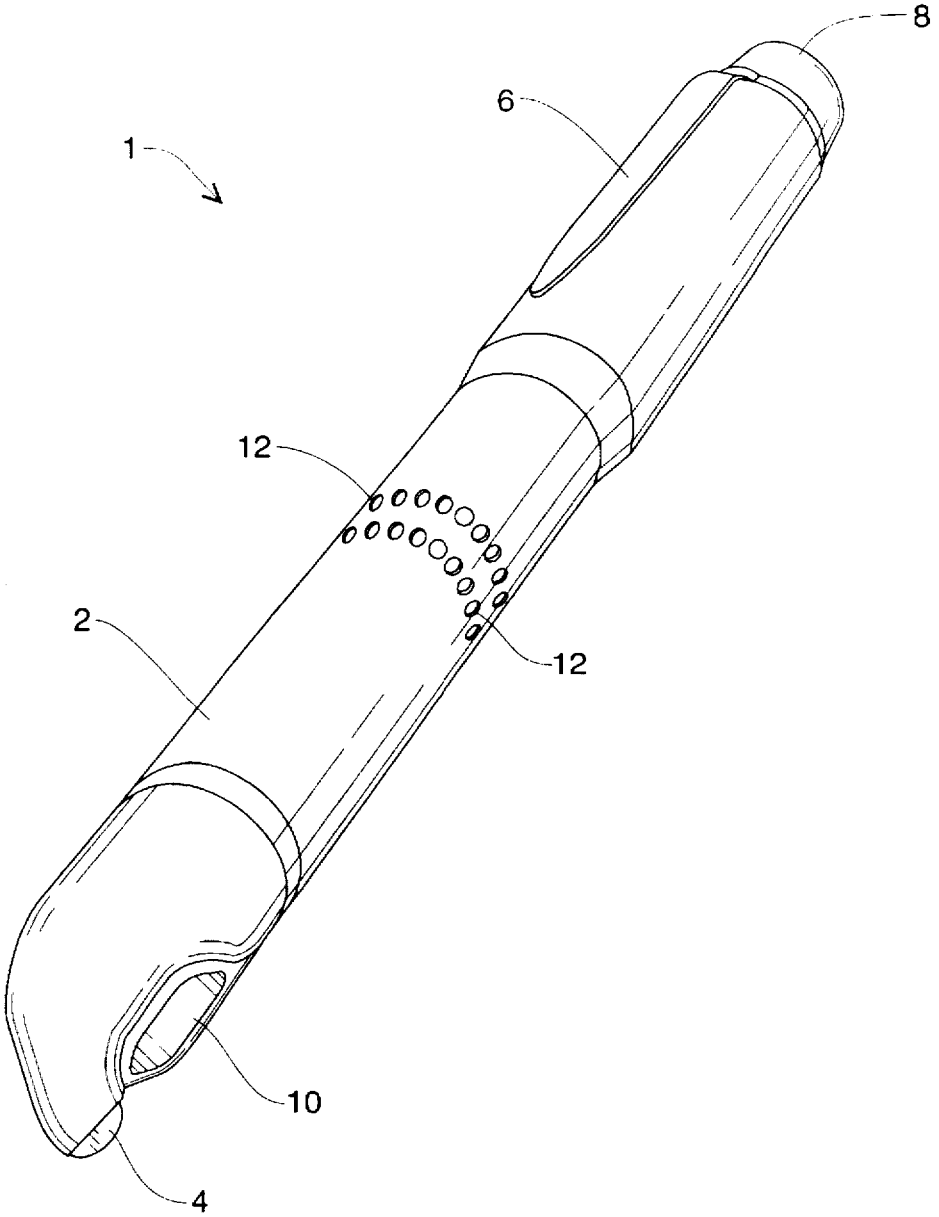
FIG. 1 is an orthographic view of the preferred embodiment of the present invention.
Figure 3:
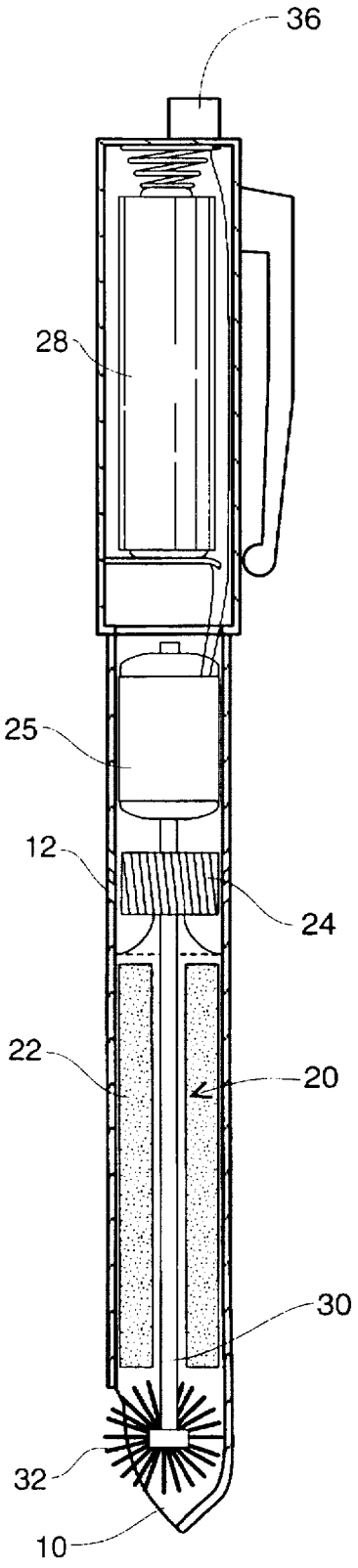
FIG. 3 is a similar cross sectional view of one alternated embodiment of the present invention.

Referring now to FIG. 1, a portable, hand held vacuum apparatus 1 is shown, according to the present invention, having a pen-shaped outer housing 2 which supports a combination scraping means 4 as well as a hanging clip 6. The clip 6 is envisioned as being of the type commonly used with pens and pencils, and therefor forms an easily portable package with can be hand-held and even transported in a user's pocket. The scraping means 4 is envisioned in its preferred embodiment as a scraper blade. However, alternate embodiments are currently envisioned, such as the one utilizing a wire or abrasive wheel 32 as shown in FIG. 3. In maintaining the overall pen-like styling, a rotating on/off switch 8 is located at the back of the apparatus 1. A vacuum intake port 10 is located at the front of the apparatus 1, and is located in close physical proximity with the scraper means 4. Additionally, at least one air discharge port 12 is provided in fluid communication with the vacuum intake port 10 and formed by and penetrating the outer housing 2.

Figure 2:
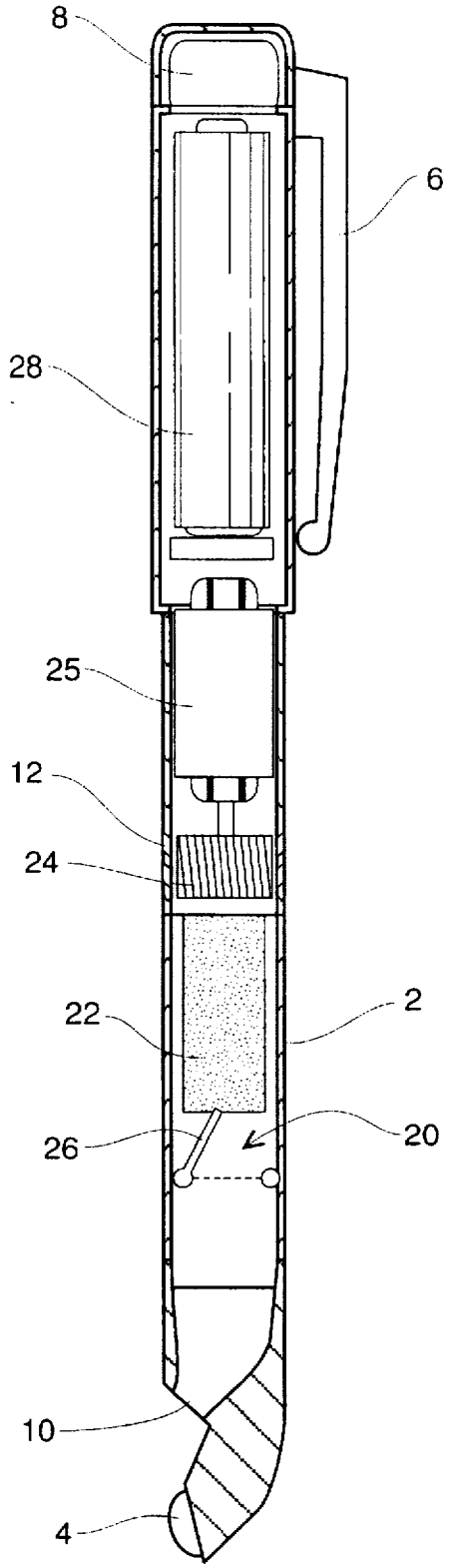
FIG. 2 is a cross sectional view taken along lines II—II shown in FIG. 1.

Referring to FIG. 2, the inner mechanical workings of the preferred embodiment of the apparatus 1 are more clearly depicted. The vacuum intake port 10 is in fluid communication with the air discharge ports 12, which are both connected by an air transfer shaft 20. A removable residue cartridge 22 having a filter is held within the air transfer shaft 20 such that air traveling through the air transfer shaft 20 passes through the residue cartridge 22 and impinges against the filer therein. A centrifugal blower 24 driven by a motor 25 also operates within the air transfer shaft 20 such as to provide a means of propelling air from the vacuum intake port 10, along the air transfer shaft 20, and out the air discharge ports 12. A one way air valve 26 is mounted near the intake port 10 in order to allow only the inward flow of air, thereby preventing the accidental discharge of debris and shavings when the blower 24 is in an unengaged state. A battery 28 is also housed within the body of the housing 2, and is in electrical contact with both the rotating on/off switch 8 as well as the motor 25 in order to provide the necessary electrical energy.

FIG. 3 shows the inner mechanical workings of one particular alternate embodiment of the apparatus 1. In this embodiment the vacuum intake port 10 is also in fluid communication with the air discharge ports 12, which are also both connected by an air transfer shaft 20. The removable residue cartridge 22 having a filter is held within the air transfer shaft 20 such that air traveling through the air transfer shaft 20 passes through the residue cartridge 22 and impinges against the filter therein. The centrifugal blower 24 driven by a motor 25 also operates within the air transfer shaft 20 such as to provide a means of propelling air from the vacuum intake port 10, along the air transfer shaft 20, and out the air discharge ports 12. Additionally, the motor 25 drives a shaft 30 which extends to the vacuum intake port 10. A wheeled abrasive means 32, such as a wire brush or abrasive wheel, is affixed to the end of the shaft 30 and provides an alternate scraping means as that shown in FIG. 2. Similarly, the battery 28 is housed within the body of the housing 2, and is in electrical contact with both an alternate on/off switching means 8 as well as the motor 25 in order to provide the necessary electrical energy.

2. Operation of the Preferred Embodiment

In operation, the present invention is utilized to replace knives, coins, or fingernails in the scraping of instant lottery tickets. With the on/off switch in an "on" position, the motor 25 runs and drives the blower 24. Air is drawn in through the vacuum intake 10, and a steady flow is created along the air transfer shaft 20 and out the discharge ports 12. The scraping means 4, or with the alternate embodiment the abrasive means 32, is then used to remove the material covering the lottery ticket. The vacuum and air flow conveniently removes any debris, and traps the debris in the residue cartridge 22, where it can be removed and discarded at a later time.

The foregoing description is included to illustrate the operation of the preferred embodiment and one alternate embodiment of the present invention, and is not meant to limit the scope of the invention. The scope of the invention is to be limited only by the following claims.

What is claimed is:

1. A combination portable vacuum and scraper apparatus comprising:

an elongated, hand held outer housing having a front end and a back end;

an on/off switch located at said back end;

a vacuum intake port located at said front end;

a scraping means for scraping flat surfaces, said scraping means affixed to said outer housing near said vacuum intake port;

at least one air discharge port formed as a penetration in said outer housing in fluid communication with said vacuum intake port;

an air transfer shaft connecting said air discharge port and said vacuum intake port;

a removable residue cartridge having a filter, said residue cartridge held within said air transfer shaft such that air traveling through said air transfer shaft passes through said residue cartridge and impinges against the filter;

a centrifugal blower driven by a motor, said blower contained within said air transfer shaft to provide a means of propelling air from said vacuum intake port, along said air transfer shaft, and out said air discharge port;

a one way air valve mounted near the vacuum intake port and covering said air transfer shaft for allowing only the inward flow of air, thereby preventing the accidental discharge of debris and shavings when said blower is in an unengaged state; and a battery housed within said housing and in electrical contact with both said on/off switch and said motor in order to provide the necessary electrical energy to operate said motor.

2. The apparatus as described in claim 1, wherein said outer housing has a conventional pen shape, the apparatus further comprising a hanging clip affixed to said outer housing.

3. The apparatus as described in claim 1, wherein said scraping means comprises a scraper blade.

4. The apparatus as described in claim 1, wherein said scraping means comprises:

a shaft extending to said vacuum intake port and having a first end and a second end, said shaft in connection with and driven by said motor at said first end; and a wheeled abrasive means affixed to said second end of said shaft.

5. A combination portable vacuum and scraper apparatus comprising:

an elongated, hand held outer housing;

a vacuum intake port located on said outer housing;

at least one air discharge port in said outer housing in fluid communication with said vacuum intake port;

an air transfer shaft connecting said air discharge port and said vacuum intake port;

a blower driven by a motor, said blower contained within said air transfer shaft to provide a means of propelling air from said vacuum intake port, along said air transfer shaft, and out said air discharge port;

a shaft extending to said vacuum intake port and having a first end and a second end, said shaft in connection with and driven by said motor at said first end; and a wheeled abrasive means for scraping flat surfaces, the wheeled abrasive means affixed to said second end of said shaft.

6. The apparatus of claim 5, in which the wheeled abrasive means is a rotary wire brush.

* * * * *